United States Patent [19]

Rothkegel

[11] Patent Number: 4,978,173

[45] Date of Patent: Dec. 18, 1990

[54] HOLDER FOR CUTTER IN MINING MACHINE

[75] Inventor: Roland Rothkegel, Voerde, Fed. Rep. of Germany

[73] Assignee: Paurat GmbH, Voerde, Fed. Rep. of Germany

[21] Appl. No.: 505,672

[22] Filed: Apr. 5, 1990

[30] Foreign Application Priority Data

Apr. 12, 1989 [DE] Fed. Rep. of Germany ..... 3911893

[51] Int. Cl.[5] ..... E21C 35/22

[52] U.S. Cl. ..... 299/81; 299/91

[58] Field of Search ..... 299/79, 81, 86, 91, 299/17; 175/339, 340, 393

[56] References Cited

U.S. PATENT DOCUMENTS 4,333,687 6/1982 Barnstorf ..... 299/81

FOREIGN PATENT DOCUMENTS 2167108 5/1986 United Kingdom ..... 299/81

2167789 6/1986 United Kingdom ..... 299/81

*Primary Examiner*—Ramon S. Britts

*Assistant Examiner*—David J. Bagnell

*Attorney, Agent, or Firm*—Herbert Dubno; Andrew Wilford

[57] ABSTRACT

A tooth holder for a cutter of a mining machine has a holder body fixed to the cutter and normally displaced thereby in a predetermined longitudinal direction. This body is formed with a longitudinally generally forwardly open bore, an outer transversely directed seat face adjacent the bore, and a feed passage opening at the outer seat. A sleeve is received in the bore and a cutter tooth is received in the sleeve. A separate nozzle body is formed with a nozzle passage having one end communicating with the feed passage at the seat and an opposite end forming a longitudinally generally forwardly open spray mouth, and a face complementary fitted to the outer seat face. A fluid is supplied under pressure to the feed passage so that the fluid exits the spray mouth. The nozzle body is releasably secured by screws or the like to the holder body with the faces engaged tightly together.

5 Claims, 2 Drawing Sheets

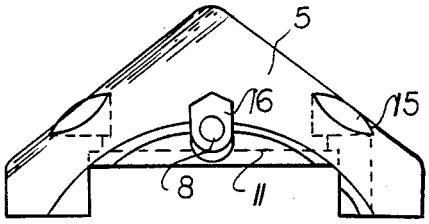
FIG. 3
FIG. 4
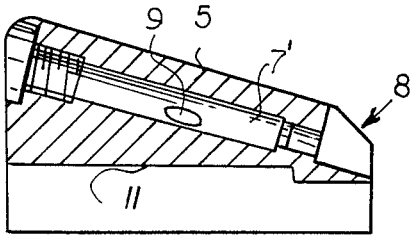

HOLDER FOR CUTTER IN MINING MACHINE

FIELD OF THE INVENTION

The present invention relates to a mining machine. More particularly this invention concerns a holder for a cutter in a mining machine.

BACKGROUND OF THE INVENTION

A mining machine cutter typically has a plurality of replaceable teeth mounted in individual holders on the outside of the cutter. Each of these holders is welded to the cutter and carries a single cutter bit or tooth that is directed generally forward in a longitudinal direction of displacement of the cutter. The cutter can be shaped like a wheel, a frustocone, or a mushroom.

As described in U.S. Pat. No. 4,333,687 of Barnstorf the holder body is unitarily formed with feed passages that connect to a nozzle that is itself mounted o the holder and that is directed longitudinally generally forward in the displacement direction. Thus a fluid, either water or a water/air mixture, fed to the nozzle is emitted as a high-power spray that strikes whatever the cutter is engaging. This serves both to cool the cutter and to carry away material freed by it.

Even though the nozzle lies invariably in the wake of the cutter, that is behind it in its travel path, it is still in a fairly exposed position. Thus it is possible for particles freed by the cutter tooth to get into and plug the nozzle, and it is even possible under some circumstances for the nozzle and holder body to be directly abraded and badly damaged.

When this happens the nozzle is put out of commission. The only way to repair it is to take the cutter off and repair it in a shop. This obviously entails expensive down time.

OBJECTS OF THE INVENTION

It is therefore an object of the present invention to provide an improved system for mounting a cutter and nozzle on a mining machine.

Another object is the provision of such an improved system for mounting a cutter and nozzle on a mining machine which overcomes the above-given disadvantages, that is which allows the holder for the cutter tooth t be repaired and/or replaced fairly easily.

SUMMARY OF THE INVENTION

A tooth holder for a cutter of a mining machine according to the invention has a holder body fixed to the cutter and normally displaced thereby in a predetermined longitudinal direction. This body is formed with a longitudinally generally forwardly open bore, an outer transversely directed seat adjacent the bore, and a feed passage opening at the outer seat. A sleeve is received in the bore and a cutter tooth is received in the sleeve. A separate nozzle body is formed with a nozzle passage having one end communicating with the feed passage at the seat and an opposite end forming a longitudinally generally forwardly open spray mouth, and a face complementary fitted to the outer seat. A fluid is supplied under pressure to the feed passage so that the fluid exits the spray mouth. The nozzle body is releasably secured by screws or the like to the holder body with the faces engaged tightly together.

Thus with the system of this invention the holder body can be removed and replaced right on the site. The respective tooth need not even be removed to replace it. Thus on-site repairs can be made relatively easily, or a new nozzle configuration, for instance a system with separate feeds for air and water, can be fitted to a machine without even taking the cutter off it.

According to this invention the faces are formed with interfitting formations. These include a groove on one of the faces and a ridge fitting complementarily therein and formed on the other face.

DESCRIPTION OF THE DRAWING

The above and other objects, features, and advantages will become more readily apparent from the following, reference being made to the accompanying drawing in which:

FIGS. 2 and 3 are views taken in the directions of respective arrow V2 and V3 of FIG. 1 of the nozzle body; and FIG. 4 is a longitudinal section through another nozzle body according to the invention.

SPECIFIC DESCRIPTION

Figure 1:
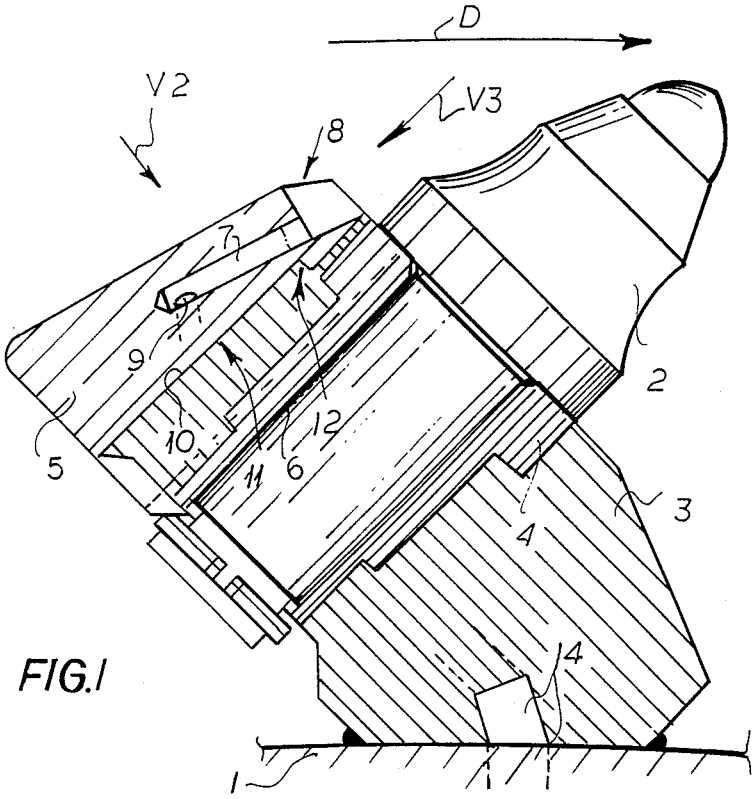
FIG. 1 is a large-scale longitudinal section through an assembly according to this invention.

As seen in FIG. 1 a cutter 1 movable in a direction D is provided with a cutter tooth or bit 2 having a shaft 6 fitted in a sleeve 4 in turn fitted in a bore of a cutter body 3 that itself is welded in place on the cutter 1. The chisel bit 2 faces generally forward in the direction D and has, as is known per se, a hardened tip used to dig into the face of the mine in which the cutter 1 is employed.

According to this invention a separate nozzle body 5, formed of steel like the body 3, is fitted to the holder body 3 and is formed with a nozzle passage 7 opening generally forward at a mouth 8 that may be fitted with a nozzle insert 16. This passage 7 communicates via passages 9 and 14 in the bodies 5 and 3 and in the cutter 1 with a source of water under high pressure. Thus a jet of water will be directed from the nozzle mouth 8 at the face roughly where it is engaged by the tip of the tooth 2.

The cutter body 3 has a laterally outwardly directed face 10 that complementarily flatly engages a laterally inwardly directed face 11 of the body 5. The face 11 is formed with a crosswise ridge 12 that fits into a complementary groove at the front of the face 10 to inhibit backward sliding of the body 5 on the body 3.

Figure 2:
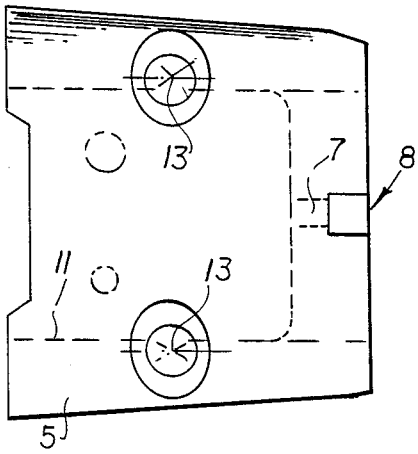

In addition as better seen in FIGS. 2 and 3 the body 5 is formed with two transversely throughgoing counterbored holes 15 through which allen-head screws 13 engage in the body 3, solidly but releasably locking the two bodies 3 and 5 together. This makes it relatively easy to remove the body 5 and replace it right in the mine, without even taking the cutter 1 off its machine.

FIG. 4 shows an arrangement where a bore 7' extending along the same axis as the bore 7 is drilled completely through the body 5 but is otherwise identical to the bore 7. The rear end of the bore 7' can be fitted with a plug or with an air-supply line.

I claim:

1. A tooth holder for a cutter of a mining machine, the holder comprising:

a holder body fixed to the cutter and normally displaced thereby in a predetermined longitudinal direction, the body being formed with a longitudinally generally forwardly open bore, an outer transversely directed seat face adjacent the bore, and a feed passage opening at the outer seat;

a sleeve received in the bore;

a cutter tooth in the sleeve;

a nozzle body formed with a nozzle passage having one end communicating with the feed passage at the seat and an opposite end forming a longitudinally generally forwardly open spray mouth, and a face complementary fitted to the outer seat face;

means for supplying a fluid under pressure to the feed passage, whereby the fluid exits the spray mouth; and means for releasably securing the nozzle body to the holder body With the faces engaged tightly together.

2. The tooth holder defined in claim 1 Wherein the faces are formed with interfitting formations.

3. The tooth holder defined in claim 1 wherein the securing means includes at least one screw engaged through the nozzle body with the holder body.

4. The tooth holder defined in claim 1 wherein one of the faces is formed with a groove and the other face is formed with a ridge fitting complementarily therein.

5. A tooth holder for a cutter of a mining machine, the holder comprising:

a holder body welded to the cutter and normally displaced thereby in a predetermined longitudinal direction, the body being formed with a longitudinally generally forwardly open bore, an outer transversely directed seat face adjacent the bore and having a transversely directed formation, and a feed passage opening at the outer seat;

a sleeve received in the bore;

a cutter tooth in the sleeve;

a nozzle body formed with a nozzle passage having one end communicating with the feed passage at the seat and an opposite end forming a longitudinally generally forwardly open spray mouth, and a face complementary fitted to the outer seat face and having a formation complementarily fitted with the formation of the holder body;

means for supplying a fluid under pressure to the feed passage, whereby the fluid exits the spray mouth; and at least one screw engaged through the nozzle body with the holder body, the screw pressing the faces tightly together.

* * * * *